US009093806B1

(12) United States Patent
Yang et al.

(10) Patent No.: US 9,093,806 B1
(45) Date of Patent: Jul. 28, 2015

(54) ELECTRICAL CONNECTOR

(71) Applicant: Cheng Uei Precision Industry Co., Ltd., New Taipei (TW)

(72) Inventors: Chih-Lin Yang, New Taipei (TW); Kuo-Chin Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/210,429

(22) Filed: Mar. 13, 2014

(51) Int. Cl.
*H01R 13/648* (2006.01)
*H01R 24/60* (2011.01)
*H01R 13/502* (2006.01)

(52) U.S. Cl.
CPC ..... *H01R 24/60* (2013.01); *H01R 13/502* (2013.01)

(58) Field of Classification Search
CPC ..... H01R 23/6873; H01R 13/506; H01R 13/6581; H01R 13/6593; H01R 13/6658; H01R 9/032; H01R 13/6592; H01R 13/6583
USPC ..... 439/676, 541.5, 607.01, 607, 27, 439/607.55, 660, 218
See application file for complete search history.

(56) References Cited

U.S. PATENT DOCUMENTS

| | | | | |
|---|---|---|---|---|
| 7,748,999 | B1 * | 7/2010 | Sun et al. | 439/79 |
| 8,251,746 | B2 * | 8/2012 | Zhang et al. | 439/607.11 |
| 8,777,666 | B2 * | 7/2014 | Golko et al. | 439/607.34 |
| 8,882,524 | B2 * | 11/2014 | Golko et al. | 439/218 |
| 8,891,216 | B2 * | 11/2014 | Mullins et al. | 361/58 |
| 8,911,260 | B2 * | 12/2014 | Golko et al. | 439/660 |

* cited by examiner

*Primary Examiner* — Xuong Chung Trans
(74) *Attorney, Agent, or Firm* — Cheng-Ju Chiang

(57) ABSTRACT

An electrical connector includes an insulating body, a plurality of terminals, a metal slice and an internal shell. The insulating body is divided into an upper half body and a lower half body which have the same structure to make the insulating body symmetric about the horizontal center plane thereof. Two face-to-face faces of the upper half body and the lower half body are respectively concaved upward and downward to form a pair of receiving cavities which together form a holding slot. The metal slice is held in the holding slot. The terminals are integrated in the upper half body and the lower half body of the insulating body. The internal shell sheathes outside the insulating body with front ends of the terminals being exposed outside through the internal shell.

14 Claims, 9 Drawing Sheets

ELECTRICAL CONNECTOR

BACKGROUND OF THE INVENTION

1. Field of the Invention

The present invention relates to a connector, and more particularly to an electrical connector.

2. The Related Art

Nowadays, electrical connectors are widely used in electronic products to realize signal transmission between the electronic products and corresponding peripheral equipments thereof. In order to meet market requirements, the electrical connectors are being at the period of mass production. With the rapid development of electronic technology, the electrical connector is required to give consideration to both high speed information transmission rate and miniaturization structure. However, the electrical connector is often mated with a mating connector in a single direction for insertion. As a result, users need to recognize both positive and negative directions of the electrical connector firstly before using the electronic product. It is inconvenient for the users.

SUMMARY OF THE INVENTION

Accordingly, an object of the present invention is to provide an electrical connector. The electrical connector includes an insulating body, a plurality of terminals, a metal slice and an internal shell. The insulating body has a base portion. A front face of the base portion extends frontward to form a tongue board having a smaller dimension than the base portion. A top face and a bottom face of the tongue board define a plurality of terminal grooves penetrating rearward through the back face of the base portion. The insulating body is divided along the horizontal center plane thereof into an upper half body and a lower half body which have the same structure to make the insulating body symmetric about the horizontal center plane thereof. A bottom face of the upper half body and a top face of the lower half body are respectively concaved upward and downward to form a pair of receiving cavities and the two receiving cavities are closed to form a holding slot. The terminals are integrated in the terminal grooves of the insulating body respectively. The metal slice is held in the holding slot of the insulating body. The internal shell has a top plate, a bottom plate and two lateral plates which together form an inserting chamber thereamong. The tongue board of the insulating body is inserted in the inserting chamber of the internal shell. Front ends of the top plate and the bottom plate of the internal shell are concaved rearward to form a pair of gaps. Front ends of the terminals are exposed outside through the gaps of the top plate and the bottom plate of the internal shell.

As described above, the insulating body is divided along the horizontal center plane thereof into the upper half body and the lower half body which have the same structure to make the insulating body symmetric about the horizontal center plane thereof, so that has no need for recognizing positive and negative directions of the electrical connector specially when using the electrical connector. And the metal slice is held in the holding slot between the upper half body and the lower half body to improve the interference of the radio frequency and enhance the EMI (Electro-Magnetic Interference) protection.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
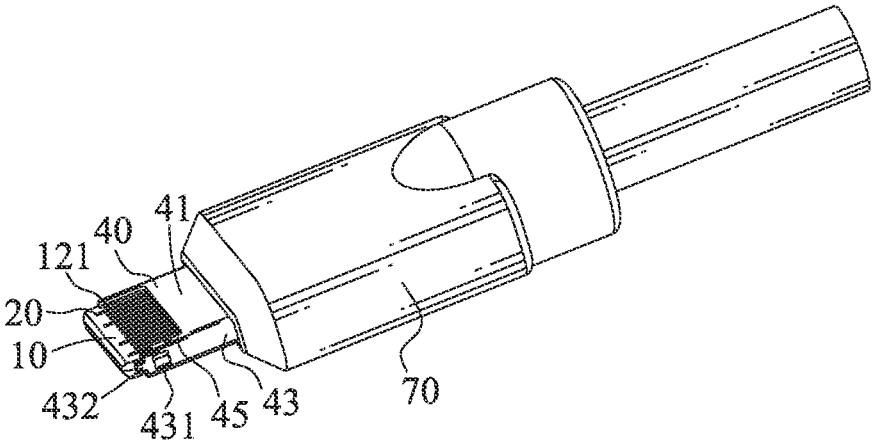
FIG. 1 is an assembled, perspective view of an electrical connector in accordance with an embodiment of the present invention.
Figure 2:
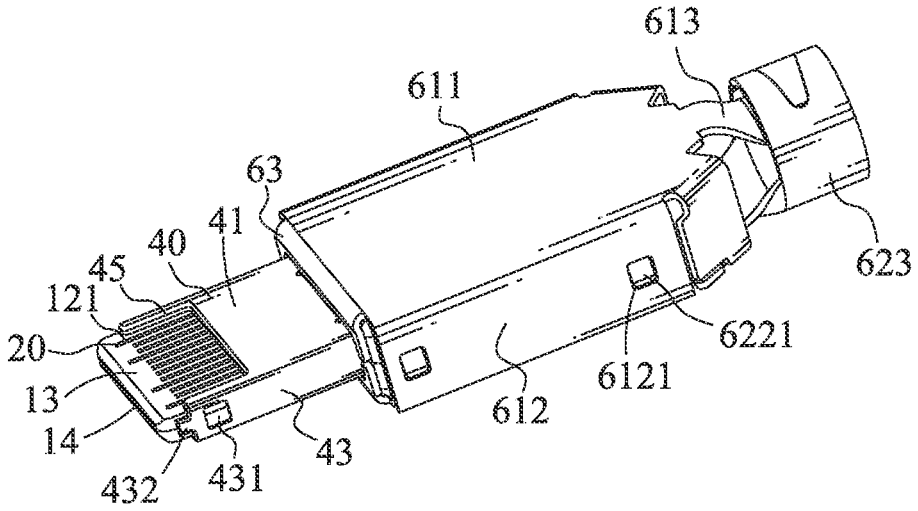
FIG. 2 is a perspective view of the electrical connector without an external housing shown in FIG. 1.
Figure 3:
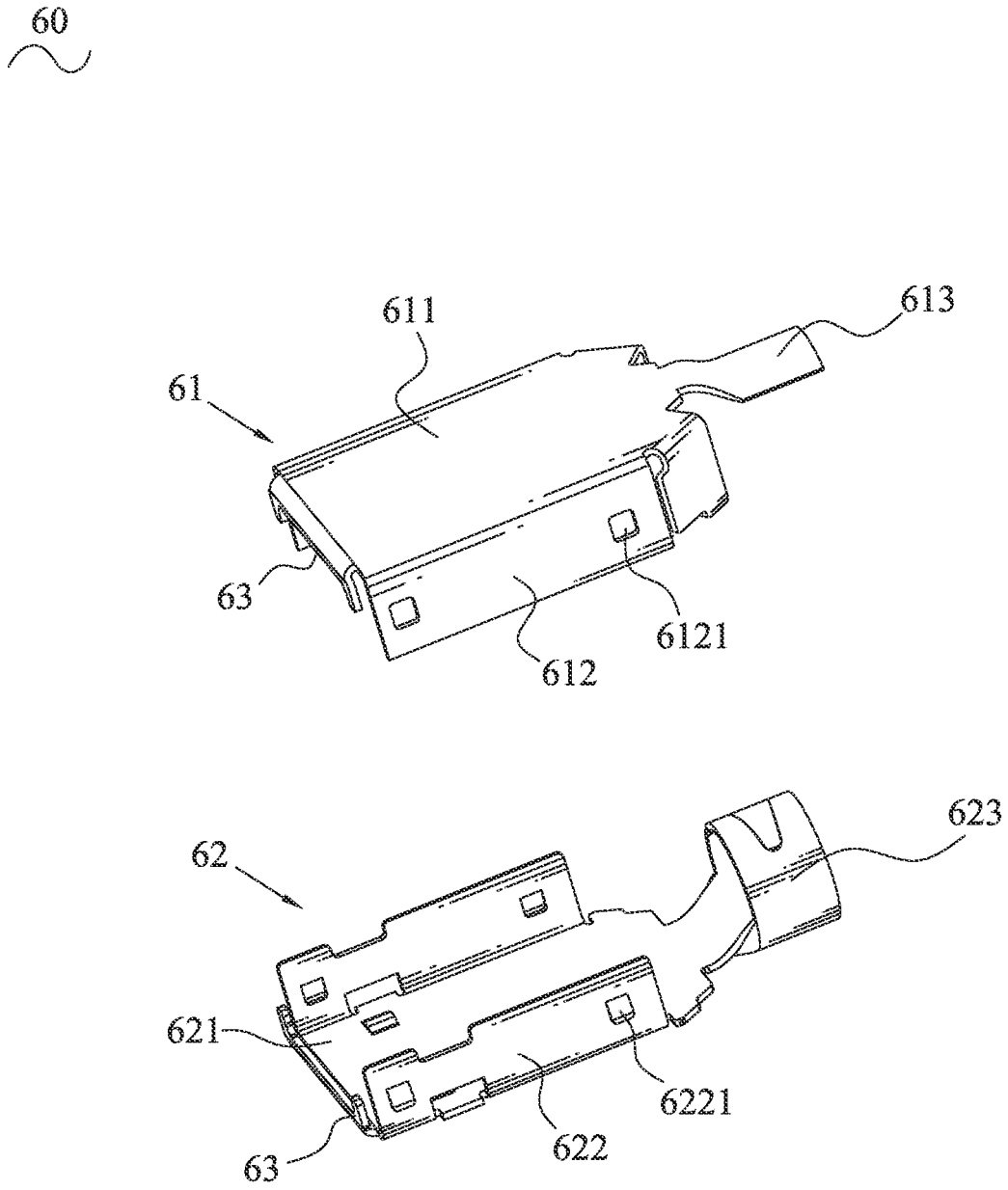
FIG. 3 is a perspective view of an external shell of the electrical connector shown in FIG. 1.
Figure 4:
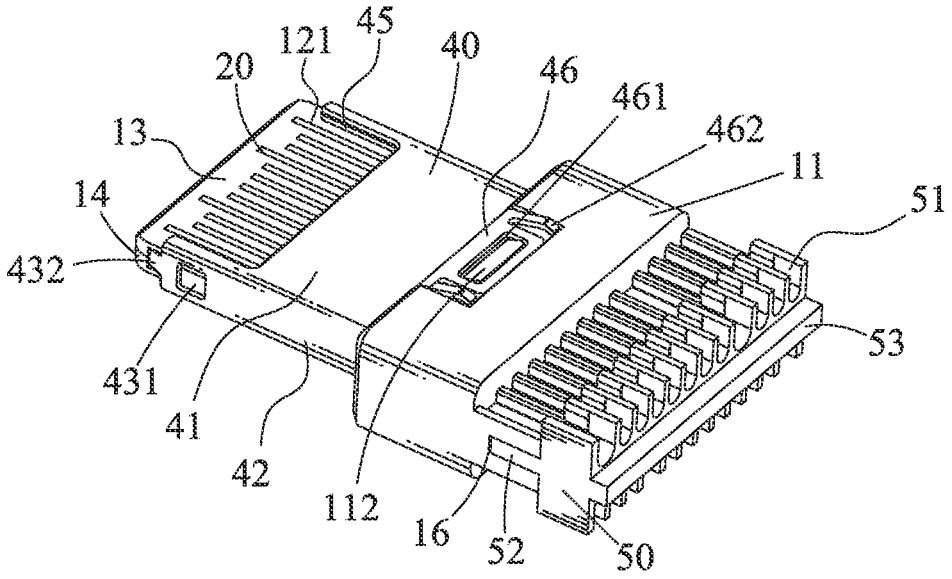
FIG. 4 is a perspective view of the internal structure of the electrical connector shown in FIG. 1.

Referring to the drawings in greater detail, and first to FIGS. 1 to 6, an embodiment of the present invention is embodied in an electrical connector. The electrical connector includes an insulating body 10, a plurality of terminals 20, a metal slice 30, an internal shell 40, a rear cap 50, an external shell 60 and an external housing 70.

Figure 5:
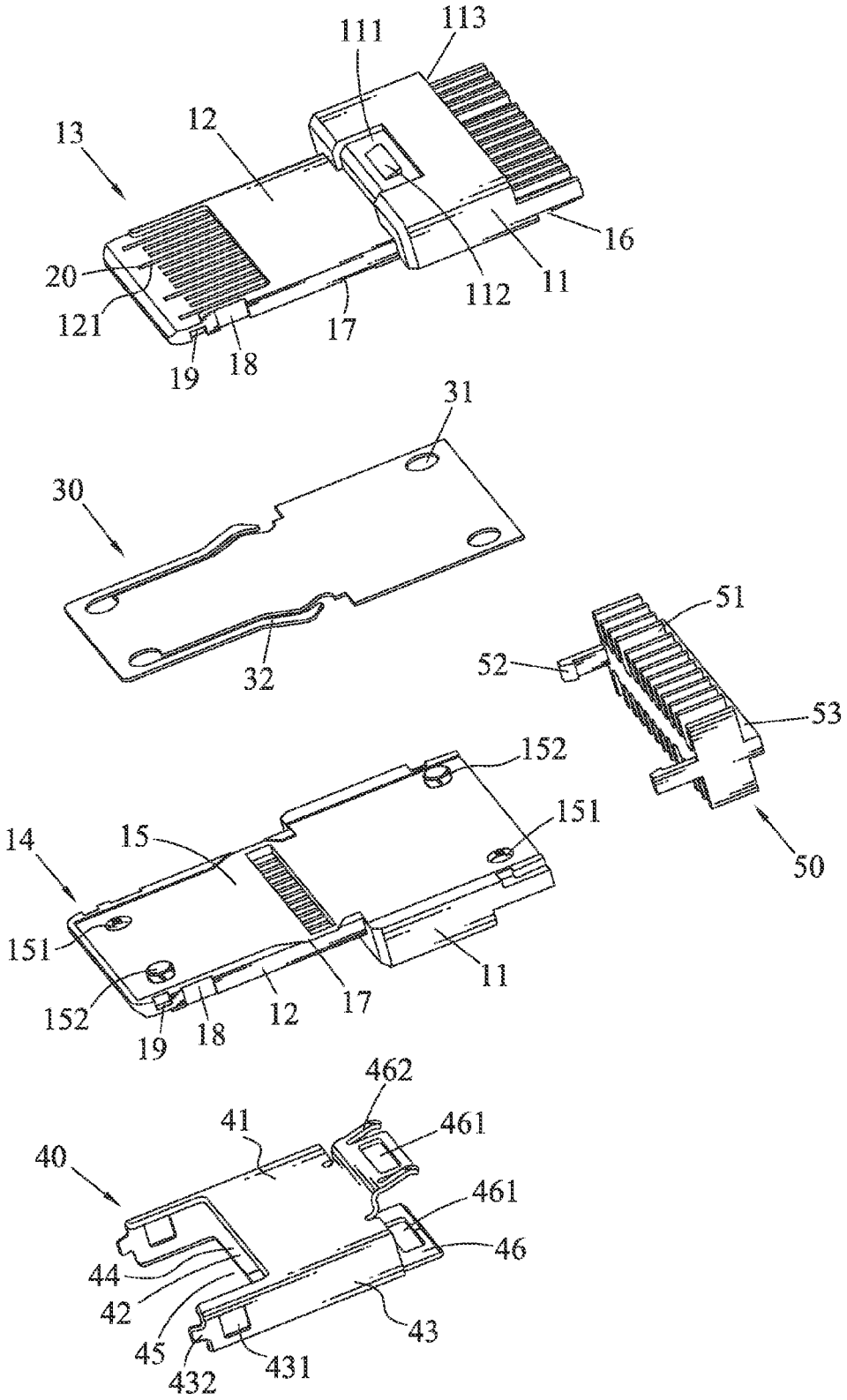
FIG. 5 is an exploded, perspective view of the electrical connector shown in FIG. 4.
Figure 6:
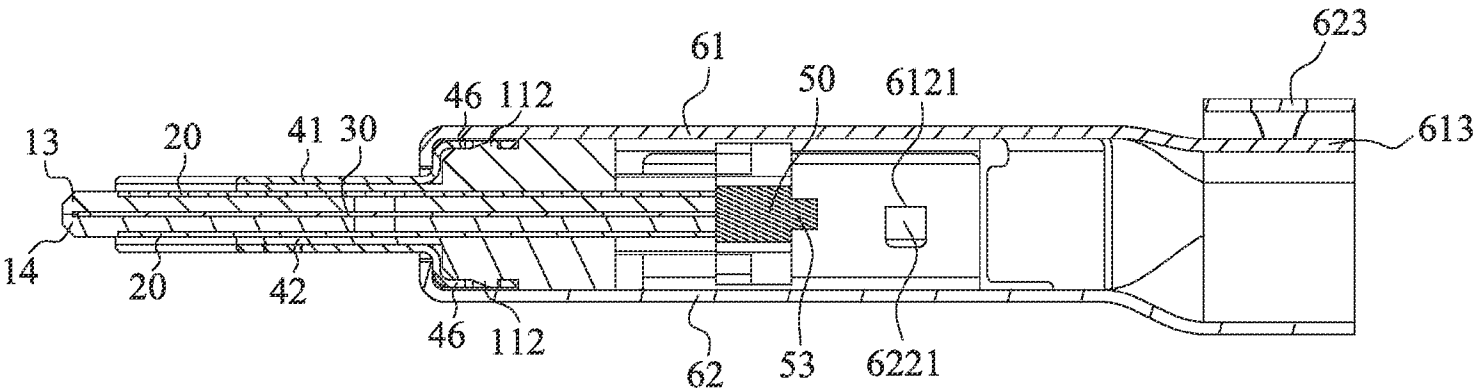
FIG. 6 is a cross-sectional view of the electrical connector shown in FIG. 2.
Figure 7:
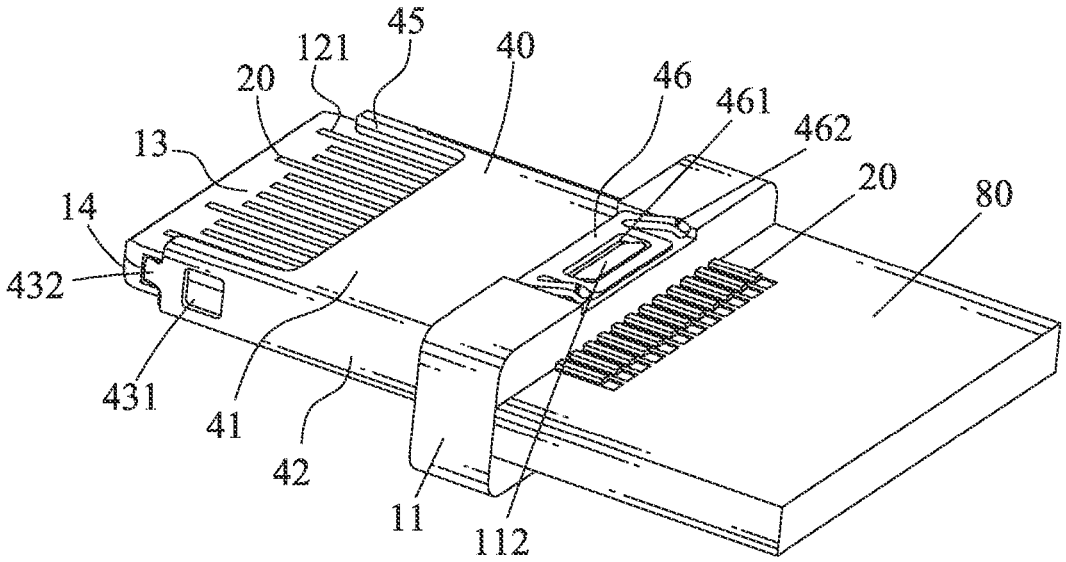
FIG. 7 is a perspective view of the internal structure of an electrical connector in accordance with another embodiment of the present invention.

Referring to FIG. 5, the insulating body 10 has a base portion 11. A front face of the base portion 11 extends frontward to form a tongue board 12 having a smaller dimension than the base portion 11. Top and bottom faces of the base portion 11 of the insulating body 10 respectively define a fastening groove 111 and a pair of buckling lumps 112 is protruded at the bottom sidewalls of the fastening grooves 111. Rear ends of a top face and a bottom face of the base portion 11 are respectively concaved downward and upward to form a pair of receiving slots 113. A top face and a bottom face of the tongue board 12 define a plurality of terminal grooves 121 penetrating rearward through the back face of the base portion 11.

The insulating body 10 is divided along the horizontal center plane thereof into an upper half body 13 and a lower half body 14 which have the same structure to make the insulating body 10 symmetric about the horizontal center plane thereof. A bottom face of the upper half body 13 and a top face of the lower half body 14 are respectively concaved upward and downward to form a pair of receiving cavities 15 and the two receiving cavities 15 are closed to form a holding slot (not labeled). Two face-to-face faces of the upper half body 13 and the lower half body 14 define at least one pair of buckling holes 151 and one pair of buckling columns 152. Two opposite sides of a rear end of the base portion 11 of the insulating body 10 are opened with a pair of fastening slots 16 and the front end of the fastening slot 16 is deeper than the rear end thereof. A rear end of the holding slot opened in the tongue board 12 of the insulating body 10 is further oppositely extended outward to penetrate through two opposite sidewalls of a rear end of the tongue board 12 to form a pair of notches 17. Two opposite sides of a front end of the tongue board 12 of the insulating body 10 define a fastening fillister 18 respectively. Two opposite sides of the front end of the tongue board 12 of the insulating body 10 further define a pair of buckling fillisters 19 located in front of the fastening fillisters 18 respectively.

The terminals 20 are integrated in the terminal grooves 121 of the insulating body 10 respectively.

The metal slice 30 is held in the holding slot of the insulating body 10. The metal slice 30 defines at least one pair of perforations 31 corresponding to the buckling columns 152 of the upper half body 13 and the lower half body 14. Two opposite sides of a front end of the metal slice 30 protrude outward and then extend rearward to form a pair of elastic arms 32 of which free ends are arched outward to pass through the notches 17 of the tongue board 12.

The internal shell 40 has a top plate 41, a bottom plate 42 and two lateral plates 43 which together form an inserting chamber 44 thereamong. Front ends of the top plate 41 and the bottom plate 42 of the internal shell 40 are concaved rearward to form a pair of gaps 45. Rear ends of the top plate 41 and the bottom plate 42 of the internal shell 40 are respectively bent upward and downward and then extend rearward to form a pair of clamping slices 46 and each clamping slice 46 is opened with a buckling aperture 461. Two opposite sides of the clamping slice 46 are die-cut open to form a pair of resilient arms 462 which are inclined upward with detail ends being bent downward. Front ends of the lateral plates 43 of the internal shell 40 are opened with a pair of fastening holes 431 facing the fastening fillisters 18 of the tongue board 12 respectively. A substantial middle of a front edge of each lateral plate 43 of the internal shell 40 extends forward and is bent inward to form a snapping ear 432.

The rear cap 50 is an integral structure. A top face and a bottom face of the rear cap 50 are opened with a plurality of clamping slots 51 penetrating through the rear cap 50 along a front-to-rear direction. Two opposite sides of a front end of the rear cap 50 extend forward and then protrude inward at the end to form a pair of fastening grabs 52. A substantial middle of a rear face of the rear cap 50 extends rearward to form a chunk 53.

The external shell 60 includes an upper half shell 61 and a lower half shell 62. The upper half shell 61 has an upper plate 611. Two opposite sides of the upper plate 611 are bent downward to form a pair of upper side plates 612. A rear edge of the upper plate 611 extends rearward to form a first contact portion 613. The upper side plates 612 of the upper half shell 61 define a plurality of openings 6121. The lower half shell 62 has a lower plate 621. Two opposite sides of the lower plate 621 are bent upward to form a pair of lower side plates 622. A rear edge of the lower plate 621 extends rearward with a tail end being rolled up to form a ring-shaped second contact portion 623. The lower side plates 622 of the lower half shell 62 are punched outward to form a plurality of buckling wedges 6221 corresponding to the openings 3121 of the upper side plates 612. Front edges of the upper plate 611 and the lower plate 621 of the external shell 60 respectively extend downward and upward to form a pair of U-shaped blocking clips 63.

The external housing 70 is integrated outside of the internal shell 40 and the external shell 50.

Referring to FIG. 1 and FIGS. 3-6, after the terminals 20 are integrated in the terminal grooves 121 of the insulating body 10, in assembly, the metal slice 30 is held in the holding slot of the insulating body 10 to improve the interference of the radio frequency. The buckling columns 152 of the upper half body 13 and the lower half body 14 pass through the perforations 31 of the metal slice 30 and are buckled in the buckling holes 151, respectively.

The internal shell 40 sheathes outside the insulating body 10 and the tongue board 12 of the insulating body 10 is inserted in the inserting chamber 44 of the internal shell 40. The clamping slices 46 of the top plate 41 and the bottom plate 42 of the internal shell 40 are held in the fastening grooves 111 of the base portion 11 of the insulating body 10. The buckling lumps 112 are buckled in the buckling apertures 461 of the clamping slices 46 of the internal shell 40 to prevent the internal shell 40 away from the insulating body 10. The resilient arms 462 of the clamping slice 46 of the top plate 41 project upward beyond the top face of the base portion 11 of the insulating body 10 to electrically abut against the inner side of the upper plate 611 of the upper half shell 61. Front ends of the terminals 20 are exposed outside through the gaps 45 of the top plate 41 and the bottom plate 42 of the internal shell 40 to contact with the mating connector (not shown) to realize the electrical connection. The snapping ears 432 of the lateral plates 43 of the internal shell 40 are snapped in the buckling fillisters 19 of the insulating body 10 respectively to prevent the internal shell 40 away from the insulating body 10. Free ends of the elastic arms 32 of the metal slice 30 pass sideward through the notches 17 of the tongue board 12 of the insulating body 10 to electrically abut against inner sides of the lateral plates 43 of the internal shell 40 so as to enhance EMI protection.

The rear cap 50 is mounted behind the base portion 11 of the insulating body 10 and the clamping slots 51 are aligned with the terminal grooves 121 respectively for clamping rear ends of the terminals 20 therein. The fastening grabs 52 of the rear cap 50 are clasped in the fastening slots 16 of the insulating body 10.

The external shell 60 sheathes outside the insulating body 10 and the internal shell 40. The upper half shell 61 of the external shell 60 covers downward the lower half shell 62. The upper side plates 612 of the upper half shell 61 abut against outer sides of the lower side plates 622 of the lower half shell 62 with the buckling wedges 6221 of the lower side plates 622 being buckled in the openings 6121 of the upper side plates 612 respectively. The first contact portion 613 of the upper half shell 61 is electrically connected with the second contact portion 623 of the lower half shell 62. The blocking clips 63 of the external shell 60 resist against the front face of the base portion 11 of the insulating body 10. The resilient arms 462 of the clamping slice 46 of the top plate 41 electrically abut against the inner side of the upper plate 611 of the upper half shell 61.

The external housing 70 is integrated outside the internal shell 40 and the external shell 60.

Referring to FIGS. 1-3 and FIGS. 7-9, another embodiment of the present invention is embodied in an electrical connector. The electrical connector includes an insulating body 10, a plurality of terminals 20, a metal slice 30, an internal shell 40, an external shell 60, an external housing 70 and a PCB 80.

Figure 8:
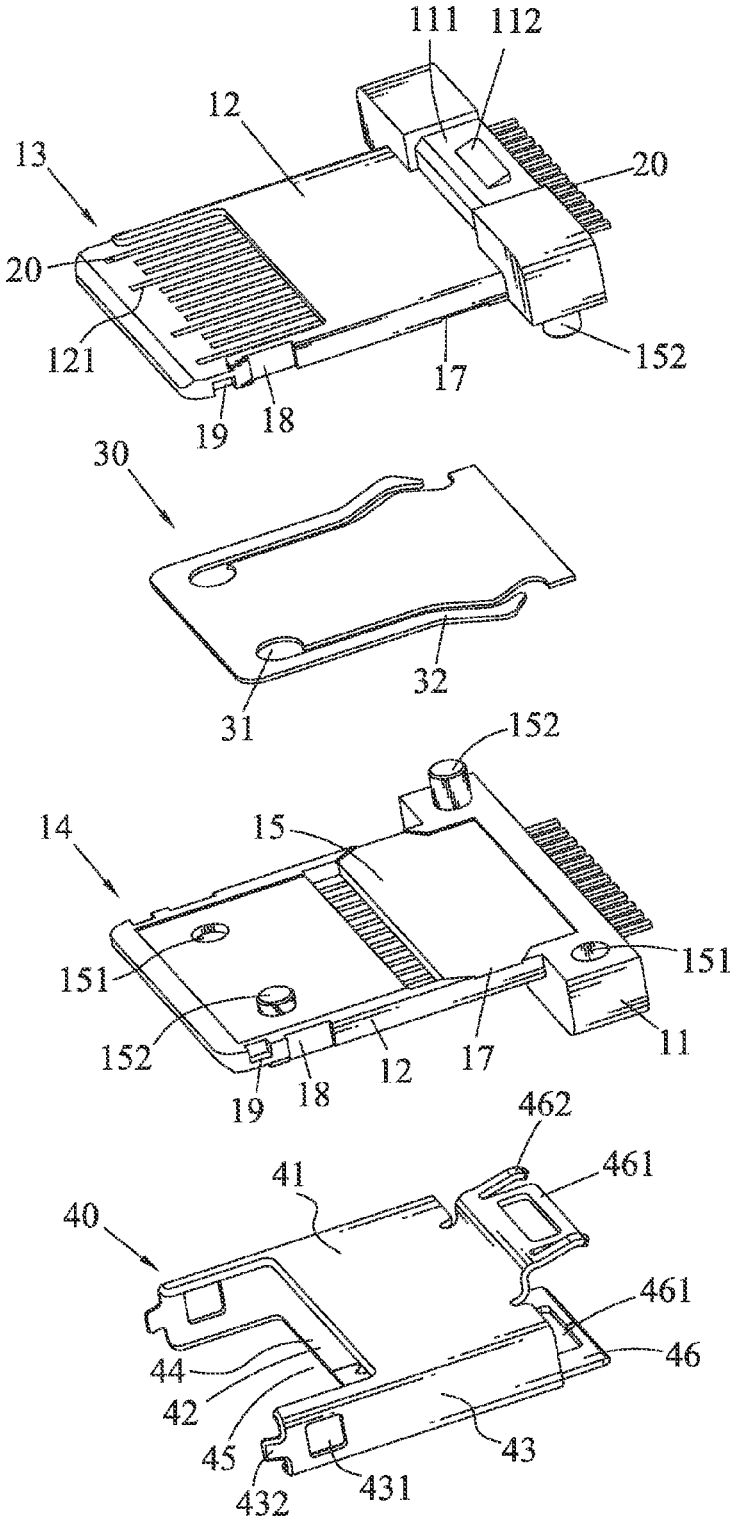
FIG. 8 is an exploded, perspective view of the electrical connector shown in FIG. 7.
Figure 9:
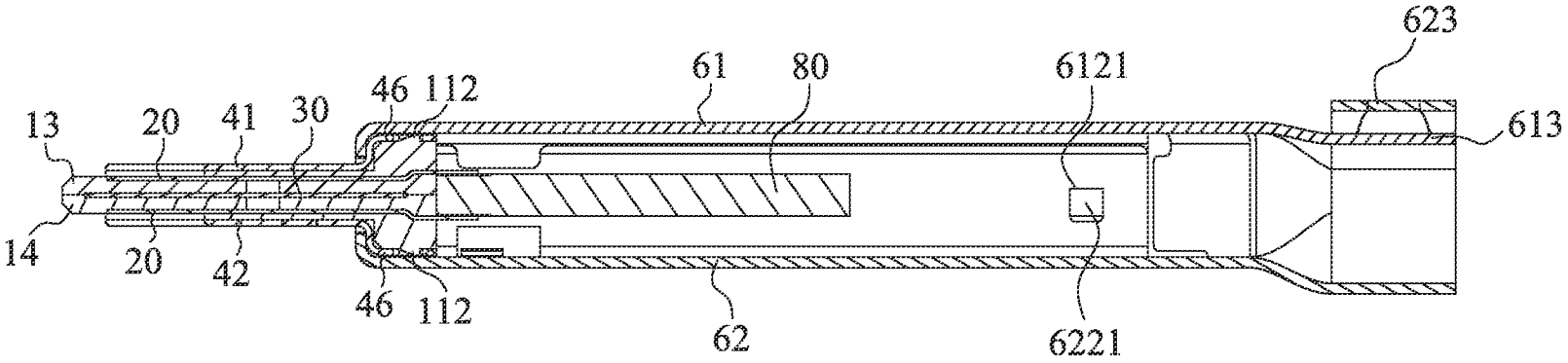
FIG. 9 is a cross-sectional view of the electrical connector of FIG. 7 together with the external shell of FIG. 3.

Referring to FIG. 8, the insulating body 10 has a base portion 11, a front face of the base portion 11 extends frontward to form a tongue board 12 having a smaller dimension than the base portion 11. Top and bottom faces of the base portion 11 of the insulating body 10 respectively define a fastening groove 111 and a pair of buckling lumps 112 is protruded at the bottom sidewalls of the fastening grooves 111. A top face and a bottom face of the tongue board 12 define a plurality of terminal grooves 121 penetrating rearward through the back face of the base portion 11.

The insulating body 10 is divided along the horizontal center plane thereof into an upper half body 13 and a lower half body 14 which have the same structure to make the insulating body 10 symmetric about the horizontal center plane thereof. A bottom face of the upper half body 13 and a top face of the lower half body 14 are respectively concaved upward and downward to form a pair of receiving cavities 15 and the two receiving cavities are closed to form a holding slot (not labeled). Two face-to-face faces of the upper half body 13 and the lower half body 14 define at least one pair of buckling holes 151 and one pair of buckling columns 152. A rear end of the holding slot opened in the tongue board 12 of the insulating body 10 is further oppositely extended outward to penetrate through two opposite sidewalls of a rear end of the tongue board 12 to form a pair of notches 17. Two opposite sides of a front end of the tongue board 12 of the insulating body 10 define a fastening fillister 18 respectively. Two opposite sides of the front end of the tongue board 12 of the insulating body 10 further define a pair of buckling fillisters 19 located in front of the fastening fillisters 18 respectively.

The terminals 20 are integrated in the terminal grooves 121 of the insulating body 10 respectively and rear ends of the terminals 20 project beyond the back face of the base portion 11 of the insulating body 10.

The metal slice 30 is held in the holding slot of the insulating body 10. The metal slice 30 defines at least one pair of perforations 31 corresponding to the buckling columns 152 of the upper half body 13 and the lower half body 14. Two opposite sides of a front end of the metal slice 30 protrude outward and then extend rearward to form a pair of elastic arms 32 of which free ends are arched outward to pass through the notches 17 of the tongue board 12.

The internal shell 40 has a top plate 41, a bottom plate 42 and two lateral plates 43 which together form an inserting chamber 44 thereamong. Front ends of the top plate 41 and the bottom plate 42 of the internal shell 40 are concaved rearward to form a pair of gaps 45. Rear ends of the top plate 41 and the bottom plate 42 of the internal shell 40 are respectively bent upward and downward and then extend rearward to form a pair of clamping slices 46 and each clamping slice 46 is opened with a buckling aperture 461. Two opposite sides of the clamping slice 46 are die-cut open to form a pair of resilient arms 462 which are inclined upward with detail ends being bent downward. Front ends of the lateral plates 43 of the internal shell 40 are opened with a pair of fastening holes 431 facing the fastening fillisters 18 of the tongue board 12 respectively. A substantial middle of a front edge of each lateral plate 43 of the internal shell 40 extends forward and is bent inward to form a snapping ear 432.

The external shell 60 includes an upper half shell 61 and a lower half shell 62. The upper half shell 61 has an upper plate 611. Two opposite sides of the upper plate 611 are bent downward to form a pair of upper side plates 612. A rear edge of the upper plate 611 extends rearward to form a first contact portion 613. The upper side plates 612 of the upper half shell 61 define a plurality of openings 6121. The lower half shell 62 has a lower plate 621. Two opposite sides of the lower plate 621 are bent upward to form a pair of lower side plates 622. A rear edge of the lower plate 621 extends rearward with a tail end being rolled up to form a ring-shaped second contact portion 623. The lower side plates 622 of the lower half shell 62 are punched outward to form a plurality of buckling wedges 6221 corresponding to the openings 6121 of the upper side plates 612. Front edges of the upper plate 611 and the lower plate 621 of the external shell 60 respectively extend downward and upward to form a pair of U-shaped blocking clips 63.

The external housing 70 is integrated outside the internal shell 40 and the external shell 60.

Referring to FIGS. 1-3 and FIGS. 7-9, after the terminals 20 are integrated in the terminal grooves 121 of the tongue board 12 of the insulating body 10 with the rear end thereof projecting beyond the back face of the base portion 11 of the insulating body 10, in assembly, the metal slice 30 is held in the holding slot of the insulating body 10 to improve the interference of the radio frequency. The buckling columns 152 of the upper half body 13 and the lower half body 14 pass through the perforations 31 of the metal slice 30 and are buckled in the buckling holes 151, respectively.

The internal shell 40 sheathes outside the insulating body 10 and the tongue board 12 of the insulating body 10 is inserted in the inserting chamber 44 of the internal shell 40. The clamping slices 46 of the top plate 41 and the bottom plate 42 of the internal shell 40 are held in the fastening grooves 111 of the base portion 11 of the insulating body 10. The buckling lumps 112 are buckled in the buckling apertures 461 of the clamping slices 46 of the internal shell 40 to prevent the internal shell 40 away from the insulating body 10. The resilient arms 462 of the clamping slice 46 of the top plate 41 project upward beyond the top face of the base portion 11 of the insulating body 10 to electrically abut against the inner side of the upper plate 611 of the upper half shell 61. Front ends of the terminals 20 are exposed outside through the gaps 45 of the top plate 41 and the bottom plate 42 of the internal shell 40 to contact with the mating connector (not shown) to realize the electrical connection. The snapping ears 432 of the lateral plates 43 of the internal shell 40 are snapped in the buckling fillisters 19 of the insulating body 10 respectively to prevent the internal shell 40 away from the insulating body 10. Free ends of the elastic arms 32 of the metal slice 30 pass sideward through the notches 17 of the tongue board 12 of the insulating body 10 to electrically abut against inner sides of the lateral plates 43 of the internal shell 40 so as to enhance EMI protection.

The PCB 80 is located behind the base portion 11 of the insulating body 10 and soldered between the rear ends of the two rows of terminals 20.

The external shell 60 sheathes outside the insulating body 10 and the internal shell 40. The upper half shell 61 of the external shell 60 covers downward the lower half shell 62. The upper side plates 612 of the upper half shell 61 abut against outer sides of the lower side plates 622 of the lower half shell 62 with the buckling wedges 6221 of the lower side plates 622 being buckled in the openings 6121 of the upper side plates 612 respectively. The first contact portion 613 of the upper half shell 61 is electrically connected with the second contact portion 623 of the lower half shell 62. The blocking clips 63 of the external shell 60 resist against the front face of the base portion 11 of the insulating body 10. The resilient arms 462 of the clamping slice 46 of the top plate 41 electrically abut against the inner side of the upper plate 611 of the upper half shell 61.

The external housing 70 is integrated outside the internal shell 40 and the external shell 60.

As described above, the insulating body 10 is divided along the horizontal center plane thereof into the upper half body 13 and the lower half body 14 which have the same structure to make the insulating body 10 symmetric about the horizontal center plane thereof, so that has no need for recognizing positive and negative directions of the electrical connector 100 specially when using the electrical connector 100. And the metal slice 30 is held in the holding slot between the upper half body 13 and the lower half body 14 to improve the interference of the radio frequency and enhance the EMI (Electro-Magnetic Interference) protection.

What is claimed is:

1. An electrical connector, comprising:

an insulating body having a base portion, a front face of the base portion extending frontward to form a tongue board having a smaller dimension than the base portion, a top face and a bottom face of the tongue board defining a plurality of terminal grooves penetrating rearward through the back face of the base portion, the insulating body being divided along the horizontal center plane thereof into an upper half body and a lower half body which have the same structure to make the insulating body symmetric about the horizontal center plane thereof, a bottom face of the upper half body and a top face of the lower half body being respectively concaved upward and downward to form a pair of receiving cavities and the two receiving cavities being closed to form a holding slot;

a plurality of terminals integrated in the terminal grooves of the insulating body respectively;

a metal slice held in the holding slot of the insulating body; and an internal shell having a top plate, a bottom plate and two lateral plates which together form an inserting chamber thereamong, the tongue board of the insulating body being inserted in the inserting chamber of the internal shell, front ends of the top plate and the bottom plate of the internal shell being concaved rearward to form a pair of gaps, front ends of the terminals being exposed outside through the gaps of the top plate and the bottom plate of the internal shell.

2. The electrical connector as claimed in claim 1, wherein top and bottom faces of the base portion of the insulating body respectively define a fastening groove and a pair of buckling lumps are protruded at the bottom sidewalls of the fastening grooves, rear ends of the top plate and the bottom plate of the internal shell are respectively bent upward and downward and then extend rearward to form a pair of clamping slices, each clamping slice is opened with a buckling aperture, the clamping slices of the top plate and the bottom plate of the internal shell are held in the fastening grooves of the base portion of the insulating body, the buckling lumps are buckled in the buckling apertures of the clamping slices of the internal shell.

3. The electrical connector as claimed in claim 1, wherein two face-to-face faces of the upper half body and the lower half body define at least one pair of buckling holes and one pair of buckling columns, the metal slice defines at least one pair of perforations corresponding to the buckling columns of the upper half body and the lower half body, the buckling columns of the upper half body and the lower half body pass through the perforations of the metal slice and are buckled in the buckling holes, respectively.

4. The electrical connector as claimed in claim 1, wherein a rear end of the holding slot opened in the tongue board of the insulating body is further oppositely extended outward to penetrate through two opposite sidewalls of a rear end of the tongue board to form a pair of notches, two opposite sides of a front end of the metal slice protrude outward and then extend rearward to form a pair of elastic arms of which free ends are arched outward to pass through the notches of the tongue board and electrically abut against inner sides of the lateral plates of the internal shell.

5. The electrical connector as claimed in claim 1, wherein two opposite sides of a front end of the tongue board of the insulating body define a fastening fillister respectively, front ends of the lateral plates of the internal shell are opened with a pair of fastening holes facing the fastening fillisters of the tongue board respectively.

6. The electrical connector as claimed in claim 5, wherein the two opposite sides of the front end of the tongue board of the insulating body further define a pair of buckling fillisters located in front of the fastening fillisters respectively, a substantial middle of a front edge of each lateral plate of the internal shell extends forward and is bent inward to form a snapping ear, the snapping ears of the lateral plates of the internal shell are snapped in the buckling fillisters of the insulating body respectively.

7. The electrical connector as claimed in claim 1, further comprising an external shell that sheathes outside the insulating body and the internal shell, the external shell including an upper half shell and a lower half shell, the upper half shell having an upper plate, two opposite sides of the upper plate being bent downward to form a pair of upper side plates, a rear edge of the upper plate extending rearward to form a first contact portion, the lower half shell having a lower plate, two opposite sides of the lower plate being bent upward to form a pair of lower side plates, a rear edge of the lower plate extending rearward with a tail end being rolled up to form a ring-shaped second contact portion, the upper half shell of the external shell covers downward the lower half shell, the first contact portion of the upper half shell is electrically connected with the second contact portion of the lower half shell.

8. The electrical connector as claimed in claim 7, wherein the upper side plates of the upper half shell define a plurality of openings, the lower side plates of the lower half shell are punched outward to form a plurality of buckling wedges corresponding to the openings of the upper side plates, the upper side plates of the upper half shell abut against outer sides of the lower side plates of the lower half shell with the buckling wedges of the lower side plates being buckled in the openings of the upper side plates respectively.

9. The electrical connector as claimed in claim 7, wherein front edges of the upper plate and the lower plate of the external shell respectively extend downward and upward to form a pair of U-shaped blocking clips, the blocking clips of the external shell resist against the front face of the base portion of the insulating body.

10. The electrical connector as claimed in claim 7, wherein a rear end of the top plate of the internal shell is bent upward and then extends rearward to form a clamping slice embedded in a top face of the base portion, two opposite sides of the clamping slice are die-cut open to form a pair of resilient arms which are inclined upward with detail ends being bent downward, the resilient arms of the clamping slice of the top plate project upward beyond the top face of the base portion of the insulating body to electrically abut against the inner side of the upper plate of the upper half shell.

11. The electrical connector as claimed in claim 7, further comprising an external housing integrated outside the internal shell and the external shell.

12. The electrical connector as claimed in claim 1, further comprising a rear cap of which a top face and a bottom face are opened with a plurality of clamping slots penetrating through the rear cap along a front-to-rear direction, the rear cap being mounted behind the base portion of the insulating body and the clamping slots being aligned with the terminal grooves respectively for clamping rear ends of the terminals therein.

13. The electrical connector as claimed in claim 12, wherein two opposite sides of a rear end of the base portion of the insulating body are opened with a pair of fastening slots and the front end of the fastening slot is deeper than the rear end thereof, two opposite sides of a front end of the rear cap extend forward and then protrude inward at the end to form a pair of fastening grabs, the fastening grabs of the rear cap are clasped in the fastening slots of the insulating body.

14. The electrical connector as claimed in claim 1, wherein rear ends of the terminals project beyond the back face of the base portion of the insulating body, the electrical connector further includes a PCB, the PCB is located behind the base portion and soldered between the rear ends of the two rows of terminals.

* * * * *